US006357118B1

(12) United States Patent
Eichhorn et al.

(10) Patent No.: US 6,357,118 B1
(45) Date of Patent: Mar. 19, 2002

(54) ELECTRIC RAZOR

(75) Inventors: Reinhold Eichhorn, Idstein; Michael Harms, Oberursel; Sebastian Hottenrott, Idstein; Peter Junk, Schmitten; Michael Odemer; Jens Störkel, both of Frankfurt; Roland Ullmann, Offenbach; Jürgen Wolf, Kriftel, all of (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/485,511

(22) PCT Filed: Apr. 25, 1998

(86) PCT No.: PCT/EP98/02470

§ 371 Date: Feb. 9, 2000

§ 102(e) Date: Feb. 9, 2000

(87) PCT Pub. No.: WO99/10140

PCT Pub. Date: Mar. 4, 1999

(30) Foreign Application Priority Data

Aug. 23, 1997 (DE) ..... 197 36 776

(51) Int. Cl.[7] ..... B26B 19/04; B26B 19/26

(52) U.S. Cl. ..... 30/43.92; 30/527

(58) Field of Search ..... 30/43.92, 43.7, 30/527, 531, 532

(56) References Cited

U.S. PATENT DOCUMENTS

| | | | | |
|---|---|---|---|---|
| 2,339,677 A | | 1/1944 | Burns | |
| 4,796,359 A | * | 1/1989 | Oprach et al. | 30/527 X |

FOREIGN PATENT DOCUMENTS

| | | |
|---|---|---|
| DE | 1 841 789 | 11/1961 |
| DE | 36 10 736 | 10/1987 |
| DE | 41 28 218 | 8/1992 |
| DE | 43 03 972 | 10/1993 |

* cited by examiner

*Primary Examiner*—Douglas D. Watts
(74) *Attorney, Agent, or Firm*—Fish & Richardson P.C.

(57) ABSTRACT

The invention is directed to a dry shaving apparatus with a housing (1) in which an electric drive mechanism (2) is provided having a drive element (3) for the transmission of a driving motion to at least one reciprocating cutting element (4), and with at least one shaving head (6) mounted on two support arms (28, 29) of a supporting frame (40 for pivotal movement about a pivot axis (Z) within a shaving head frame (7), said shaving head being formed by at least two cooperating cutting elements (4, 5) disposed in the shaving head frame (7), wherein the shaving head (6) is mounted and held for pivotal movement about the pivot axis (Z) by means of a conical bearing (K) acted upon by a spring force of a spring element (50).

24 Claims, 6 Drawing Sheets

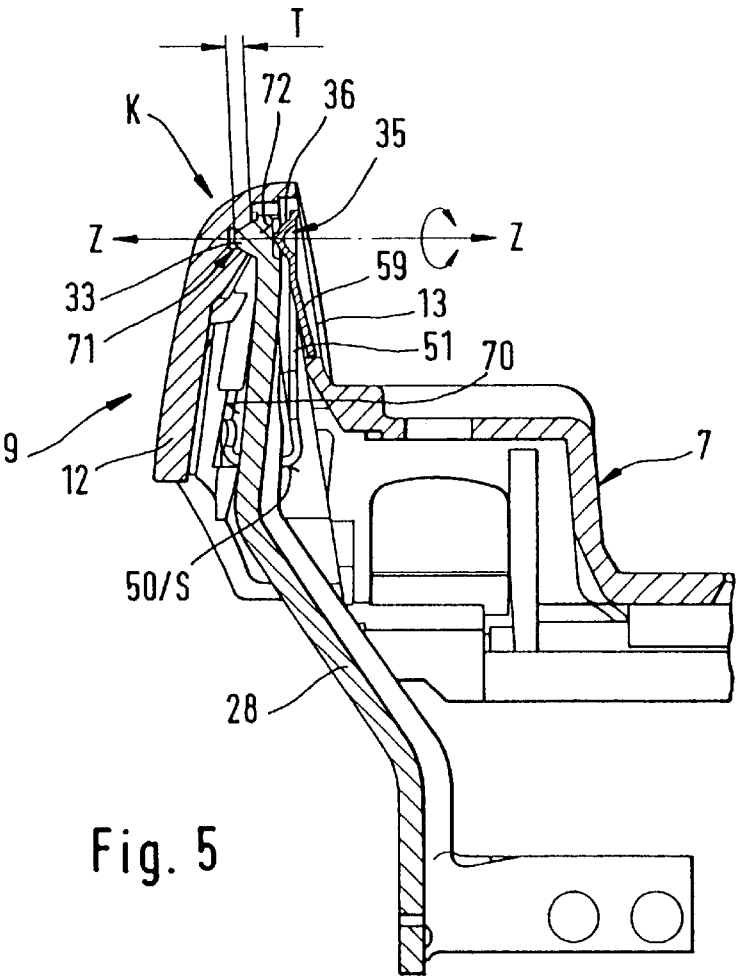
Fig. 5
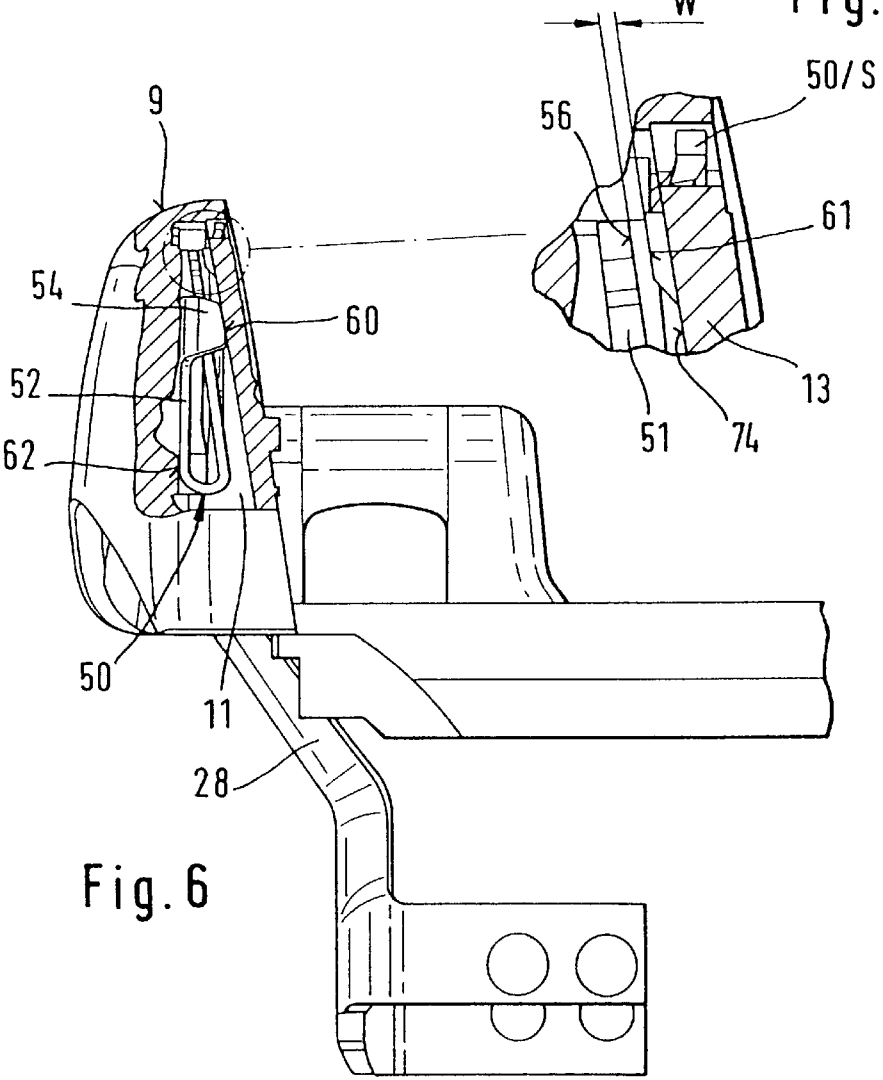
Fig. 6
Fig. 7

ELECTRIC RAZOR

BACKGROUND

This invention relates to a dry shaving apparatus with a housing in which an electric drive mechanism is provided having a drive element for the transmission of a driving motion to at least one reciprocating cutting element, and with at least one shaving head mounted on two support arms of a supporting frame for pivotal movement about a pivot axis within a shaving head frame, the shaving head being formed by at least two cooperating cutting elements disposed in shaving head frame.

A dry shaving apparatus of the type initially referred to is known from DE 36 10 736 C2. The shaving head frame of the shaving head including cutting elements is mounted on two support arms of a supporting frame for pivotal motion about a pivot axis Z. The pivot bearings are formed by a cylinder element which is pivotally received in a bearing bore and can be a component part of a cylindrical pin or a fastening screw.

It is an object of the present invention to improve in an apparatus of the type identified in the foregoing the bearing arrangement of a shaving head pivotal about a pivot axis. The bearing arrangement should reliably withstand any contact pressures exerted on the cutting elements during use of the dry shaving apparatus as well as any movements of the shaving head. In addition, it is desirable for the shaving head to be readily mountable on and demountable from the support arms.

SUMMARY

According to the present invention, this object is accomplished in a dry shaving apparatus of the type initially referred to, characterized in that the shaving head is mounted and held for pivotal movement about the pivot axis by means of a conical bearing acted upon by spring force of a spring element.

According to the present invention, for a dry shaving apparatus of the type initially referred to a further solution of this object is presented by a dry shaving apparatus of the type initially referred to, characterized in that the shaving head is mounted and held for pivotal movement about the pivot axis by means of a conical bearing acted upon by spring force of a spring element and is mounted and held for oscillation in at least one other direction of movement.

Each of the two solutions referred to in the foregoing ensures a reliable, zero play mounting of shaving heads movably carried on support arms. The conical bearings acted upon by a spring force of a spring element compensate, within a predetermined range, for the contact pressures exerted on the shaving head during operation without causing separation of the components of the conical bearing including the conical bearing's fastening elements. Any wear occurring on the components of the conical bearing during the service life of the dry shaving apparatus is compensated for automatically. Where a screwed connection is involved as, for example, in DE 36 70 732 C2 initially referred to—see FIG. 11—, it may happen that the screwed connection works loose as a result of the movement of the shaving head, a mounting screw, once worked loose, being known to be unable to return of itself to its originally tightened position. In consequence, the function of the shaving head is more or less impaired or, even worse, fails to be performed.

A further advantage derivable from the present invention resides in the utilization of a conical bearing which affords ease and economy of manufacture and ready assembly with the associated spring element in the interior of the shaving head's shaving head frame by means of a snap-fit connection. Furthermore, the snap-fit connection provided also affords ease of demounting should this become necessary.

A preferred embodiment of the present invention is characterized in that, unlike the pivotal movements about the pivot axis, one of the other directions of movement is determined by the directions of movement of a cutting element. Being an oscillating movement, this further movement of the shaving head, which is associated with the pivotal movement of the shaving head about the pivot axis Z, is conducive to the threading of the hairs into the cutting area of cooperating cutting elements. Oscillating movements and/or pivotal movements of shaving heads present continuous loads which are balanced out by both of the aforementioned Solutions in advantageous manner.

According to a preferred embodiment of the present invention, provision is made for the conical bearing to be formed by an envelope surface of a cone and by an annular surface of a depression shaped in a conical configuration. This configuration of the conical bearing provides for distribution of the contact pressures exerted on the shaving head to the envelope surface of the cone and the annular surface of the conical depression. In a further aspect of the present invention, the depression is preferably provided in an end wall of an end cheek of the shaving head frame. In a preferred embodiment of the present invention, the depression is provided in an inner wall of an outboard end wall of the shaving head frame.

In a preferred aspect of the present invention the cone is fastened to the support arm.

In an advantageous embodiment of the present invention the spring force is producible by a spring element abutting at least one wall of the shaving head frame as well as the support arm. To provide for a particularly advantageous cooperation of the conical depression with the cone and support arm and the spring element as well, an abutment surface for the spring element is provided on the support arm on the side facing away from the cone.

In a preferred embodiment of the present invention a receiving chamber for the support arm and the spring element is provided in each end cheek of the shaving head frame. This arrangement ensures simple integration of the support arms in the shaving head frame. In consequence, the outer walls of the shaving head are free from support elements and may be used for the employment or arrangement of other devices or fixtures on the shaving head.

In another aspect of this embodiment provision is made for a respective stop for the spring element on opposed end walls of the receiving chamber.

A further advantage results according to the invention in that an opening is provided in the end wall of the end cheek. This opening can be put to a plurality of uses. For example, it may facilitate significantly the assembly and/or demounting of the snap-fit connection between the support arms and the shaving head frame in connection with the spring element, in addition to serving the function of a detent element for the spring element.

In a preferred embodiment of the present invention the spring element is constructed as a leg spring.

In a further aspect of this embodiment a detent element is provided on the spring element. Preferably the detent element is constructed as a detent arm.

For the purpose of a locally definable transmission of the spring force of the spring element to the support arm, a substantially hemispherical projection acting as pressure element is provided on the spring element. In a further aspect of the present invention the leg spring includes at least two spring legs extending towards one another in substantially triangular shape. In a further aspect of this embodiment one spring leg has two associated spring legs. In a still further aspect of this embodiment, the projection is provided on the one spring leg, and the associated spring legs are each provided with a stop nose which is arranged in a direction opposite to the projection in a manner protruding relative to the one spring leg. In this embodiment, preferably, one end of the spring leg is engageable with the stop of the end wall, while the opposite end is engageable through the stop nose with a first stop of the opposite end wall. In a preferred embodiment of the present invention, with the spring element in installed condition a distance is present between a second stop of the end wall and the stop of the spring leg. This embodiment is further characterized in that the penetration depth T of the cone into the conical depression is greater than the distance W. By suitably dimensioning the penetration depth T and the distance W it is possible to introduce the support arm into the receiving chamber until the cone snaps into the conical depression for the purpose of forming a conical bearing, thereby ensuring a reliable, secure mounting of the shaving head on the support arms once the leg spring is clipped on.

The provision of a further resilient detent arm on the leg spring which in assembled condition is biased into engagement with an opening provided in the inboard end wall where it bears against an inner wall of the opening secures the mounting of the shaving head on the support arms such that demounting of the shaving head from the support arms can only be effected by exerting deliberately a pressure on the resilient detent arm.

This type of snap-fit connection reliably withstands any stresses, strains and loads acting on the shaving head, simplifies both assembly and demounting of the shaving head and, moreover, affords low-cost manufacture.

According to an embodiment of the present invention, at least one support arm is of an elastic configuration. In a further embodiment of the present invention the elastic force is producible by pressure exerted by opposed walls of the shaving head frame on the support arms.

Further advantages and details of the present invention will become apparent from the subsequent description and the accompanying drawing illustrating a preferred embodiment of the present invention.

BRIEF DESCRIPTION OF THE DRAWINGS

FIG. 5 is a cross sectional view of an end cheek of the shaving head frame, showing also the support arm and the spring element in the area of the pivot axis Z;

FIG. 6 is a partly sectional view of an end cheek of the shaving head frame in the area in front of the pivot axis Z;

FIG. 7 is a view, on an enlarged scale, of a detail of the part section of FIG. 6 in the area of the second stop of the end wall and the stop of the spring leg.

DETAILED DESCRIPTION

Figure 1:
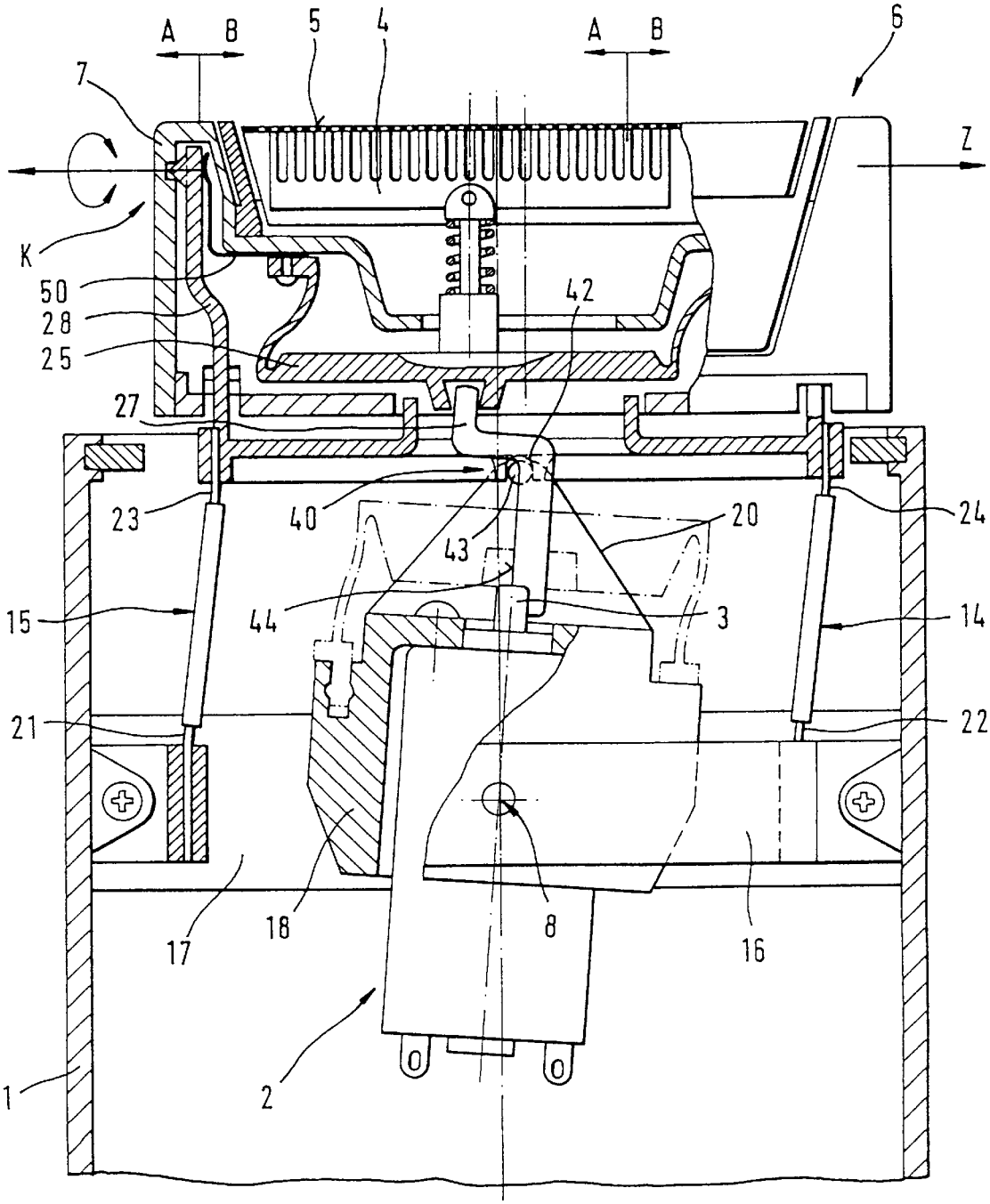
FIG. 1 is a sectional view of the housing and the shaving head of a dry shaving apparatus equipped with a shaving head mounted for both pivoting and oscillating motion.

FIG. 1 shows the housing 1 of a dry shaving apparatus with support elements 16, 17 on which an electric drive mechanism 2 fixedly disposed in a bearing cage 18 is mounted for oscillation about an axis of oscillation 8 by means of a pivot bearing. The electric drive mechanism 2 is shown in a position of oscillation in which the reciprocating shaving head 6 has reached a point of reversal from the direction of movement B to the direction of movement A.

The shaving head 6 is mounted on the support elements 16, 17 for oscillation in the directions of movement A and B through a supporting frame 40 and through swing arms 14, 15 having links 21, 22, 23, 24. The supporting frame 40 is connected through an engaging device to a housing portion 20 of the bearing cage 18 for transmitting the oscillatory motion of the electric drive mechanism 2 about the axis of oscillation 8. The engaging device is comprised of a pin 43 engaging in a recess 42, said recess 42 being formed in a wall 30—see FIG. 2—of the supporting frame 40 and said pin 43 being provided on the housing portion 20 of the bearing cage 18. The electric drive mechanism 2 comprises an electric motor having a drive element 3 configured as a rotary shaft to which an eccentric device 27 configured as a double eccentric device 44 is secured in order to transmit the driving motion from the drive element 3 through the opening 31 in the wall 30 of the supporting frame 40 to an oscillatory bridge structure 25 provided in the shaving head frame 7 of the shaving head 6. The oscillatory bridge structure 25 has a slot of a dovetail-type configuration in which the pin of the eccentric device 27 configured as double eccentric device 44 engages. The dovetail-type configuration of the slot ensures a wear-free transmission of the driving motion from the drive element 3 to the oscillatory bridge structure 25 because the angles of the dovetail configuration are fitted to suit the position of oscillation of the electric drive mechanism 2 in operation. The supporting frame 40 with the support arms 28, 29 provided thereon—see FIG. 2—ensures an oscillatory motion of the shaving head 6 in the directions of movement A and B in addition to ensuring, through conically formed joints, a pivotal motion of a shaving head 6 equipped with one or more cutter arrangements about the pivot axis Z.

Figure 2:
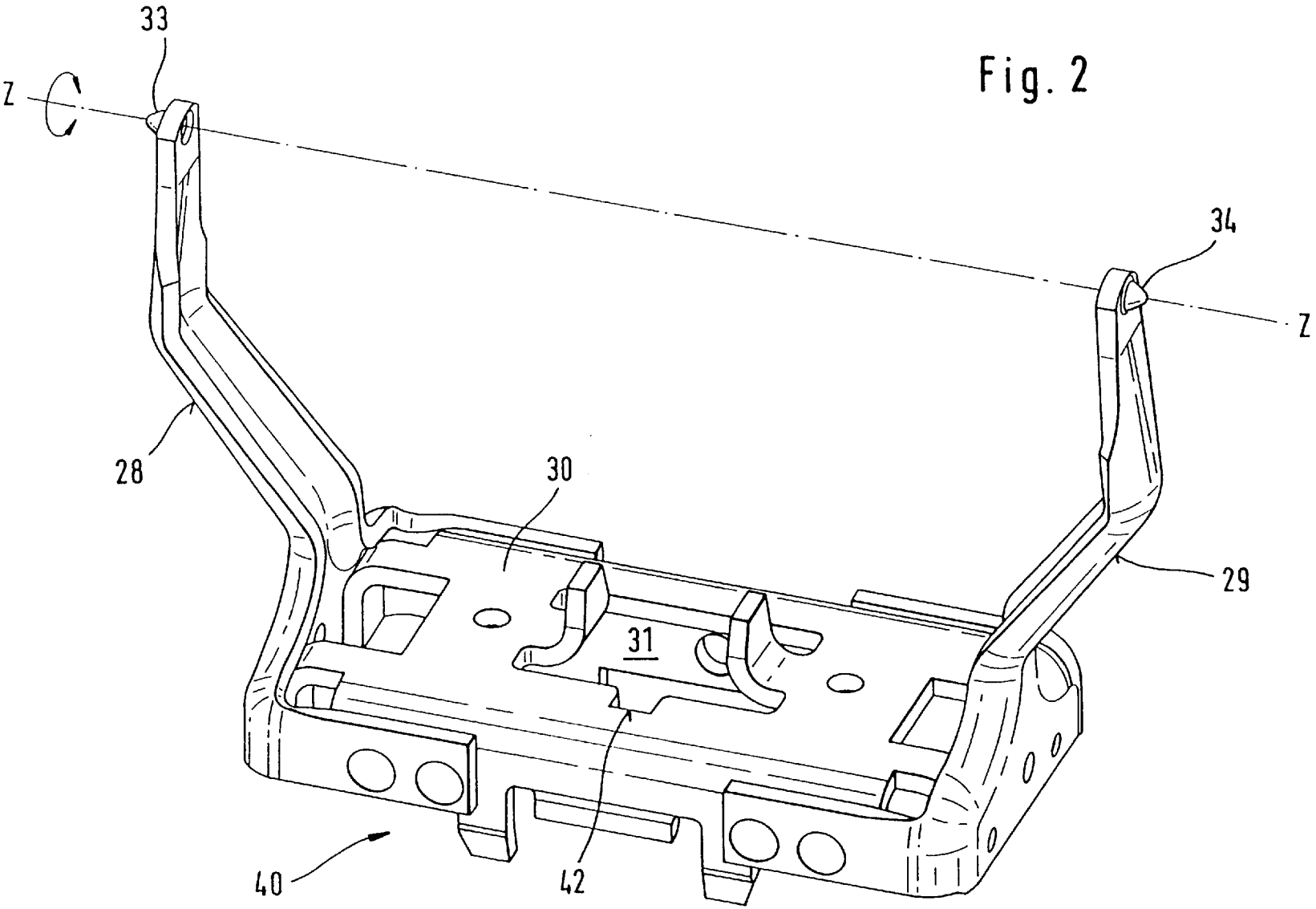
FIG. 2 is a perspective view of a supporting frame with support arms provided thereon.

FIG. 2 shows a perspective view of the supporting frame 40 with support arms 28 and 29 provided thereon. The support arms 28 and 29 may be formed integrally with the supporting frame 40 or—but not shown—may be manufactured separately and fastened to the supporting frame 40 by means of a welded connection, for example. To ensure coupling engagement of the electric drive mechanism 2 with at least one of the cutters, an opening 31 is provided in the upper wall 30 of the supporting frame 40.

Provided at the ends of the two support arms 28, 29 of identical construction is a respective cone 33, 34 arranged such that the pivot axis Z extends through the apices of the cones with the shaving head 6 in mounted condition. The cone 33, 34 may be molded integrally with the support arm 28, 29, respectively, forming a component part thereof, or it may be embossed in the support arm in an embossing operation, or made separately for subsequent attachment to the support arm as by means of a riveting operation.

Figure 3:
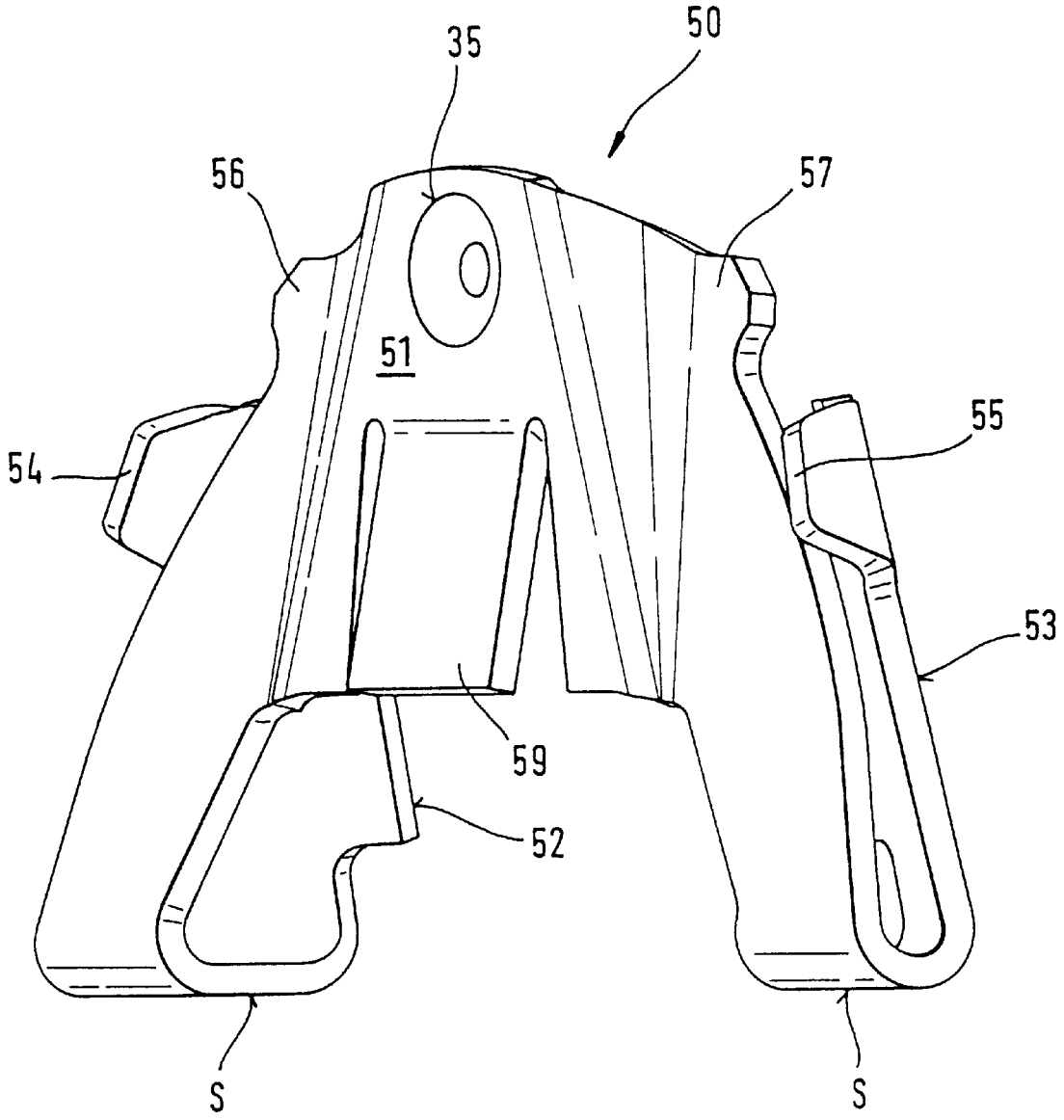
FIG. 3 is a view of a spring element constructed as a leg spring S.

FIG. 3 is a perspective view of a spring element 50 shown in biased condition. The spring element 50 is constructed as a leg spring S. The leg spring S is comprised of three spring legs 51, 52, 53 disposed in such relative arrangement that the 20 spring legs 51 and 52 as well as 51 and 53 occupy a substantially triangular position relative to each other in bent and relaxed state. A depression 35 embossed in the spring leg 51 produces on the opposite side—see FIG. 5—an essentially hemispherical projection 36 as pressure element. At its end remote from the depression 35 the spring leg 51 is cut out in U-shape, thereby producing two spring arms which when bent merge into the spring legs 52 and 53. Proceeding from the U-shaped cutout two notches are provided in the spring leg 51. The blade formed by these notches is bent slightly outwardly for the purpose of producing a resilient detent element. The detent element is formed as a detent arm 59, for example.

In relaxed condition—not shown—the ends of the spring legs 52 and 53, which are subjected to an expanding action when mounted, abut the spring leg 51. In this position stop noses 54 and 55 provided on the spring legs 52 and 53 protrude beyond the outer contour of the spring arms of the spring leg 51. On either side of the depression 35 the spring leg 51 is suitably shaped to provide a respective stop 56 and 57. Each stop 56 and 57 is associated with a second stop 61 provided in a receiving chamber 11 in the respective end cheek 9 and 10—see FIG. 4.

Figure 4:
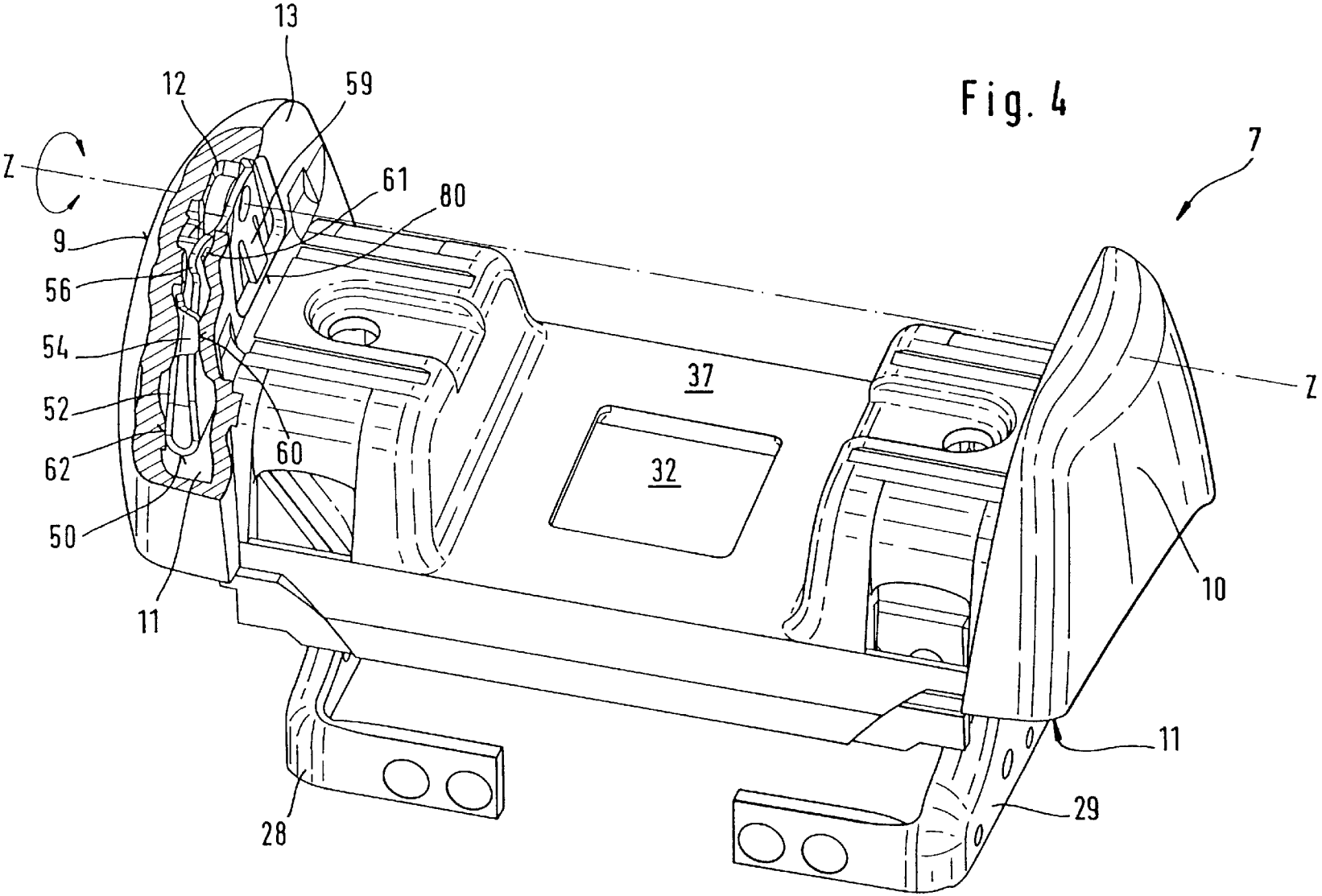
FIG. 4 is a perspective view of a shaving head showing support arms in engagement with the end cheeks, and a partly sectional view of an end cheek to show the interior of the receiving chamber with the spring element arranged therein.

FIG. 4 shows a perspective view of the shaving head frame 7 with a housing wall 37 connecting the end cheeks 9 and 10 and having in its middle an opening 32 for coupling engagement of a cutting element 4 with an oscillatory bridge structure 25—see FIG. 1. The end cheek 10 is attached to the support arm 29 and the end cheek 9 to the support arm 28.

Provided in the end cheeks 9 and 10 of the shaving head frame 7 are receiving chambers 11 of identical construction for accommodating and attaching the shaving head frame 7 to the support arms 28 and 29 and the necessary spring elements 50. One side of a receiving chamber 11 is shown, for example, in a part section through the housing wall of the end cheek 9 and will be explained in more detail in the following. This partly sectional view visibly presents only one side, that is, an arrangement lying on the one side of the pivot axis Z and a cooperating relationship of stops of the spring element 50 to abutments provided in the receiving chamber 11. The arrangement and cooperating relationship of comparable stops of the spring element 50—see FIG. 3—to their abutments in the receiving chamber 11 are duplicated on the other side of the pivot axis Z in the receiving chamber 11—not presented visibly. The construction of the receiving chamber 11 and the opening 80 in the end cheek 9 is duplicated in the end cheek 10 of the shaving head frame 7, as is the cooperating relationship of stops of the spring element 50 to abutments.

The receiving chamber 11 is comprised of an outboard end wall 12 and an inboard end wall 13 which in upward direction converge to form a closed housing while at the opposite end they are open, meaning that they are spaced at least partially at such a relative distance as to ensure introduction of the respective support arms 28 and 29 and the spring elements 50 as well. Provided on the inner wall side of the inboard end wall 13 on either side of the pivot axis Z are, respectively, a first stop 60 and a second stop 61 for the spring element 50 configured as leg spring S, with a distance existing between the stops 56, 57 of the spring leg 51 and the second stops 61 in the illustrated assembled condition of the leg spring held in tension. The end of the leg spring S remote from the stops 56 and 57 has its spring legs 52 and 53 in abutment with two third stops 62 provided on the inner side of the outboard end wall 12. The detent arm 59 of the spring element 50 is biased into engagement with the opening 80 provided in the end wall where it bears against a side wall of the opening 80.

By means of a conical bearing in the outboard end wall 12 of the end cheeks 9 and 10 and under the action of the spring force of the spring element 50, the support arms 28 and 29 are mounted and held for pivotal movement about the pivot axis Z with the shaving head frame 7. Further details of the bearing arrangement are illustrated in FIGS. 6 and 7 and will be described in greater detail in the following:

FIG. 5 shows a cross section through the shaving head frame 7, the support arm 28 and the leg spring S in the area of the end cheek 9. Provided in the inner wall 70 of the outboard end wall 12 of the end cheek 9 is a conical depression 71 receiving and holding the cone provided on the support arm 28 under the action of the spring force of the leg spring S. The spring leg 51 of the leg spring S transmits the spring force through the projection 36 formed by the depression 35 to the abutment surface 72 of the support arm 28, causing the envelope surface of the cone 33 to be in sliding engagement with the annular surface of the conical depression 71. The penetration depth of the cone 33 into the conical depression 71 is identified by T.

FIG. 6 shows the shaving head frame of FIG. 5 partly sectioned through the wall of the end cheek 9 in front of the pivot axis Z. The section shows clearly the engagement of the spring leg 52 with the third stop 62 and the engagement of the stop nose 54 with the first stop 60 for the purpose of producing the spring tension acting on the support arm 28.

FIG. 7 shows the upper end, lying in the area of the pivot axis Z—see FIG. 6—, of the leg spring S with the stop 56. In assembled condition the stop 56 is spaced a distance W relative to the second stop 61 which is provided on the inner wall 74 of the inboard end wall 13.

Figure 8:
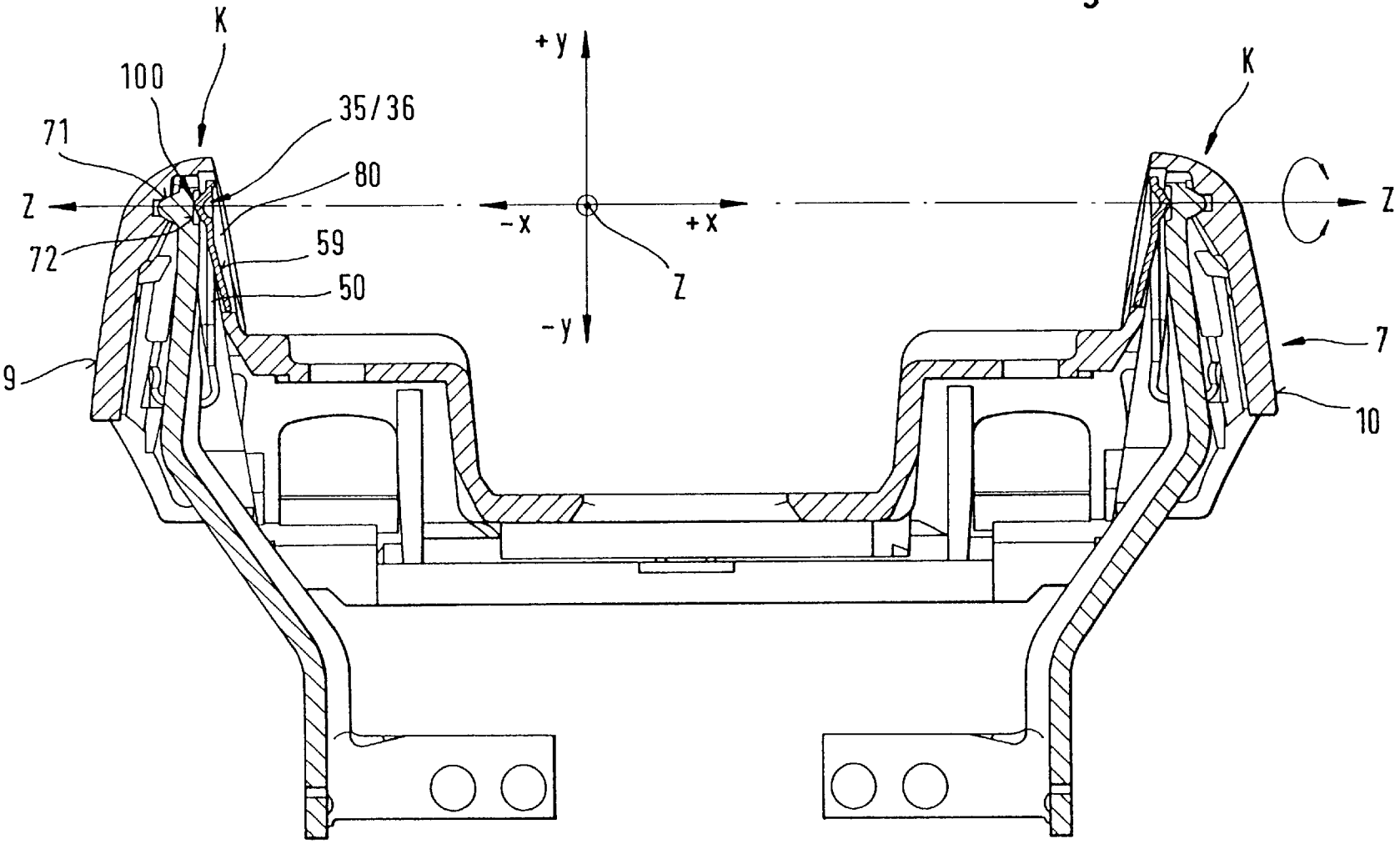
FIG. 8 is a cross sectional view of a shaving head's shaving head frame mounted on support arms for both pivoting and oscillating motion through the pivot axis Z, and an x, y and z chart.

The contact pressures exerted on the shaving head 7—see x-y-z chart of FIG. 8—in radial direction, that is, in both the y and z direction, produce in the conical bearing K of the end cheek 9 a resultant force in the direction +x. These contact pressures are transmitted at the point 100 of pressure application via the projection 36 to the leg spring S bearing through its spring legs 52 and 53 against the third stop 62 and through its stop noses 54 and 55 against the first stops 60 in the receiving chamber 11 of the shaving head frame 7. The contact pressures are balanced out by the spring tension of the biased leg spring S up to a predetermined magnitude. When the contact pressures exceed this magnitude the point 100 of pressure application moves in the direction +x. This causes the leg spring S to be deformed by an amount corresponding to dimension W. With its stops 56 and 57 the leg spring S moves into engagement with the second stops 61 on the inboard end wall 13, whereby any further deformation of the leg spring is prevented. Because the magnitude of the dimension W is smaller than the penetration depth T of the cone 33 into the conical depression 71, the cone 33 is unable to be urged out of the conical depression 71 under the action of contact pressures occurring during the shave. The situation is alike with the conical bearing K provided in the end cheek 10, yet opposite in sign, that is, positive=negative and negative=positive.

What is claimed is:

1. A dry shaving apparatus comprising:

a housing;

a shaving head frame mounted on the housing;

a shaving head with at least two cooperating cutting elements, at least one of the cooperating cutting elements being a reciprocating cutting element;

a supporting frame coupled to said housing, the supporting frame having two support arms for mounting the shaving head within the shaving head frame, the supporting frame defining a pivot axis;

a conical bearing between the shaving head frame and the two support arms;

a spring element for applying a spring force to the conical bearing; and an electric drive mechanism provided within said housing, the electric drive mechanism having a drive element for the transmission of a driving motion to the reciprocating cutting element;

wherein the shaving head is mounted and held for pivotal movement about the pivot axis by the conical bearing acted upon by the spring force of the spring element.

2. The dry shaving apparatus of claim 1, wherein the conical bearing is slidable in a radial direction relative to a direction of the pivotal movement between a first and a second position, the shaving head being mounted and held by the conical bearing for oscillation in the radial direction.

3. The dry shaving apparatus of claim 2, wherein the radial direction corresponds to a direction of movement of the reciprocating cutting element.

4. The dry shaving apparatus of claim 1, wherein the conical bearing includes an envelope surface of a cone and an annular surface of a depression shaped in a conical configuration.

5. The dry shaving apparatus of claim 4, wherein the shaving head frame includes an end cheek, the depression being provided in an end wall of the end check.

6. The dry shaving apparatus of claim 5, wherein the end wall of the end cheek is an inner wall of an outboard end wall of the shaving head frame.

7. The dry shaving apparatus of claim 4, wherein the cone is fastened to one of the support arms.

8. The dry shaving apparatus of claim 7, wherein the spring element abuts at least one wall of the shaving head frame as well as said one of the support arms.

9. The dry shaving apparatus of claim 8, wherein an abutment surface for the spring element is provided on said one of the support arms on a side facing away from the cone.

10. The dry shaving apparatus of claim 5, including two spring elements, the shaving head frame including two end cheeks, each end cheek defining a respective receiving chamber for one of the two support arms and a corresponding one of the two spring elements.

11. The dry shaving apparatus of claim 10, wherein at least one stop for each of the spring elements is provided on each of opposed end walls of each of the receiving chambers.

12. The dry shaving apparatus of claim 11, wherein an opening is provided in the end wall of one of the end cheeks.

13. The dry shaving apparatus of claim 12, wherein the spring element is constructed as a leg spring.

14. The dry shaving apparatus of claim 13, wherein the spring element includes a detent element.

15. The dry shaving apparatus of claim 14, wherein the detent element is constructed as a detent arm.

16. The dry shaving apparatus of claim 13, wherein a substantially hemispherical projection is provided on the spring element to act as a pressure element.

17. The dry shaving apparatus of claim 14, wherein the leg spring includes at least two spring legs extending toward one another in substantially triangular shape.

18. The dry shaving apparatus of claim 17, wherein one of said at least two spring legs includes two associated spring legs.

19. The dry shaving apparatus of claim 18, wherein the substantially hemispherical projection is provided on another of said at least two spring legs, and said two associated spring legs of said one of said two spring legs are each provided with a stop nose arranged in a direction opposite to the substantially hemispherical projection in a manner protruding relative to said another of said at least two spring legs.

20. The dry shaving apparatus of claim 19, wherein said at least one stop includes a pair of first stops and a pair of second stops, one end of each of said two associated spring legs being engageable with the pair of first stops of the end wall, and the opposite end being engageable through the stop nose with the pair of second stops of an opposite end wall of the cheek.

21. The dry shaving apparatus of claim 20, wherein the end wall of the check includes a third stop, said another of the at least two spring legs includes a stop surface and, with the spring element in an installed condition, a distance is present between the third stop of the end wall and the stop surface of said another of the at least two spring legs.

22. The dry shaving apparatus of claim 21, wherein a penetration depth defined by an amount of penetration of the cone into the depression is greater than said distance between the third stop and the stop surface.

23. The dry shaving apparatus of claim 22, wherein at least one of the support arms is of an elastic configuration.

24. The dry shaving apparatus of claim 23, wherein an elastic force is producible by pressure exerted by opposed walls of the shaving head frame on the support arms.

* * * * *

UNITED STATES PATENT AND TRADEMARK OFFICE

CERTIFICATE OF CORRECTION

PATENT NO. : 6,357,118 B1 
DATED : March 19, 2002
INVENTOR(S) : Michael Odemer, Peter Junk, Roland Ullmann, Michael Harms, Reinhold Eichhorn, Jurgen Wolf, Sebastian Hottenrott and Jens Storkel It is certified that error appears in the above-identified patent and that said Letters Patent is hereby corrected as shown below:

Column 5,
Line 5, delete “20”.

Column 7,
Line 31, “check” should be -- cheek --.

Column 8,
Line 4, “clement” should be -- element --.
Line 35, “check” should be -- cheek--.

Signed and Sealed this

Twentieth Day of August, 2002

*Attest:*

*Attesting Officer*

JAMES E. ROGAN
*Director of the United States Patent and Trademark Office*